US010953429B2

(12) United States Patent
Vander Woude et al.

(10) Patent No.: US 10,953,429 B2
(45) Date of Patent: Mar. 23, 2021

(54) SYSTEM AND METHOD FOR DISPENSER

(71) Applicants: Bo Vander Woude, Bloomington, IN (US); Joshua Esnard, Pittsboro, NC (US); Jason Battle, Chicago, IL (US)

(72) Inventors: Bo Vander Woude, Bloomington, IN (US); Joshua Esnard, Pittsboro, NC (US); Jason Battle, Chicago, IL (US)

( * ) Notice: Subject to any disclaimer, the term of this patent is extended or adjusted under 35 U.S.C. 154(b) by 0 days.

(21) Appl. No.: 16/945,877

(22) Filed: Aug. 2, 2020

(65) Prior Publication Data

US 2020/0360964 A1 Nov. 19, 2020

Related U.S. Application Data

(63) Continuation-in-part of application No. 29/689,959, filed on May 3, 2019.

(51) Int. Cl.

| | |
|---|---|
| ***B43M 11/06*** | (2006.01) |
| ***B05C 17/00*** | (2006.01) |
| ***B05C 1/04*** | (2006.01) |
| ***A45D 34/04*** | (2006.01) |
| ***B05C 1/06*** | (2006.01) |
| *A45D 34/00* | (2006.01) |

(52) U.S. Cl.

CPC ..... *B05C 17/002* (2013.01); *A45D 34/04* (2013.01); *B05C 1/04* (2013.01); *B05C 1/06* (2013.01); *A45D 2034/005* (2013.01)

(58) Field of Classification Search

CPC ..... B05C 1/04; B01C 1/06; A45D 34/04
USPC ..... 401/183, 202
See application file for complete search history.

(56) References Cited

U.S. PATENT DOCUMENTS

| | | | | |
|---|---|---|---|---|
| 2,947,015 | A * | 8/1960 | Burt | B65D 47/42 401/183 |
| 2,986,762 | A * | 6/1961 | Webb | A47L 23/05 401/6 |
| 4,077,725 | A | 3/1978 | Slautterback | |
| 4,889,441 | A | 12/1989 | Tice | |
| 5,006,004 | A | 4/1991 | Dirksing et al. | |
| 6,550,996 | B1 * | 4/2003 | Rayfield | A45D 40/00 401/206 |
| 10,064,535 | B2 | 9/2018 | Azelton et al. | |
| 2008/0205963 | A1 | 8/2008 | Schmidig | |
| 2015/0289744 | A1 | 10/2015 | Pupuhi et al. | |

* cited by examiner

*Primary Examiner* — Jennifer C Chiang
(74) *Attorney, Agent, or Firm* — Christopher Mayle; Thomas E. LaGrandeur; Bold IP, PLLC

(57) ABSTRACT

A system and method directed for a dispenser designed to have interchangeable components including a reservoir base for holding a liquid with an ergonomic handle, a detachable applicator compartment for holding an applicator, and a removable top cover and hook for hanging or for storage purposes.

17 Claims, 5 Drawing Sheets

SYSTEM AND METHOD FOR DISPENSER

CROSS REFERENCE TO RELATED APPLICATIONS

This application is a continuation in part of U.S. Design patent application No. 29/689,959 filed on May 3, 2019, which is incorporated by reference in its entirety.

FIELD OF DISCLOSURE

The field of disclosure is generally directed to dispensers and more particularly to interchangeable dispensers that may be used to topically apply a fluid to the skin of a person or to another surface and stored for further use.

BACKGROUND

Conventional dispensers and applicators rely on outdated methods of application on the skin or other substances. For instance the method may involve the utilization of the applicator in itself such as a bar soap, but this causes erosion or degradation of the product over time which is expedited when the applicator comes into contact with another substance such as water. Eventually the applicator becomes too small to use and must be discarded. Another method is where the applicator is a carrier for the fluid being applied to the user or another substance such as a sponge or loofah. These types of carriers often have built up soap residue and mold and prone to odor. Other methods include dispensers that deliver the fluid from an internal reservoir to the applicator but these also have soap residue build up and mold, are not easy to interchange and replace, as well as secondary fluids or debris from the target surface are pulled into or toward the internal reservoir. Thus exists a need for an improved system and method for a dispenser.

SUMMARY

The disclosure presented herein relates to a dispenser system comprising: a base reservoir configured to hold a fluid, an applicator compartment housing an applicator, the applicator compartment removably connected to the base reservoir, wherein when the applicator compartment is connected to the base reservoir, fluid is movable from the base reservoir in or onto the applicator, a top cover, the top cover removably connected to the applicator compartment, the top cover configured to cover applicator when connected to the applicator component, base reservoir made of a compressible material, the base reservoir ergonomically contoured to receive the hand of a user, the base reservoir having a top portion and bottom portion of a greater circumference than a middle portion along a vertical axis, the top cover comprising a hook positionable over an apparatus, the base reservoir having a neck portion extending upward from the top portion, the neck portion of a smaller circumference than the top portion, the neck portion having a series of threads, the applicator compartment having a neck portion extending upward, the neck portion having a series of threads that are connectable with thread receiving components on the top cover, the applicator compartment having a hollow inner chamber with thread receiving elements that are connectable with the series of threads on the neck portion of the base reservoir and an outer chamber surrounding the inner chamber along the vertical axis, the applicator compartment having an upper chamber, the upper chamber having a bottom surface with a hole in the center wherein fluid is movable from the base reservoir into the inner chamber and then into the upper chamber through the hole, the upper chamber having a series of apertures wherein secondary fluids flowing on or into applicator flow down through apertures into the outer chamber and out of the dispenser.

The disclosure presented herein also relates to a dispenser system comprising: a base reservoir configured to hold a fluid an applicator compartment housing an applicator, the applicator compartment removably connected to the base reservoir, wherein when the applicator compartment is connected to the base reservoir, fluid is movable from the base reservoir in or onto the applicator, the applicator compartment having a hollow inner chamber with thread receiving elements that are connectable with the series of threads on the neck portion of the base reservoir and an outer chamber surrounding the inner chamber along the vertical axis, the applicator compartment having an upper chamber, the upper chamber having a bottom surface with a hole in the center wherein fluid is movable from the base reservoir into the inner chamber and then into the upper chamber through the hole, the upper chamber having a series of apertures wherein secondary fluids flowing on or into applicator flow down through apertures into the outer chamber and out of the dispenser, the base reservoir having a neck portion extending upward from the top portion, the neck portion of a smaller circumference than the top portion, the neck portion having a series of threads, the base reservoir having a neck portion extending upward from the top portion, the neck portion of a smaller circumference than the top portion, the neck portion having a series of threads, the base reservoir made of a compressible material, the base reservoir ergonomically contoured to receive the hand of a user, the base reservoir having a top portion and bottom portion of a greater circumference than a middle portion along a vertical axis, the applicator having a hole through the applicator to produce a rupture effect around at top of the hole, the dispenser further comprising a top cover, the top cover removably connected to the applicator compartment, the top cover configured to cover applicator when connected to the applicator component, the top cover having a hook.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
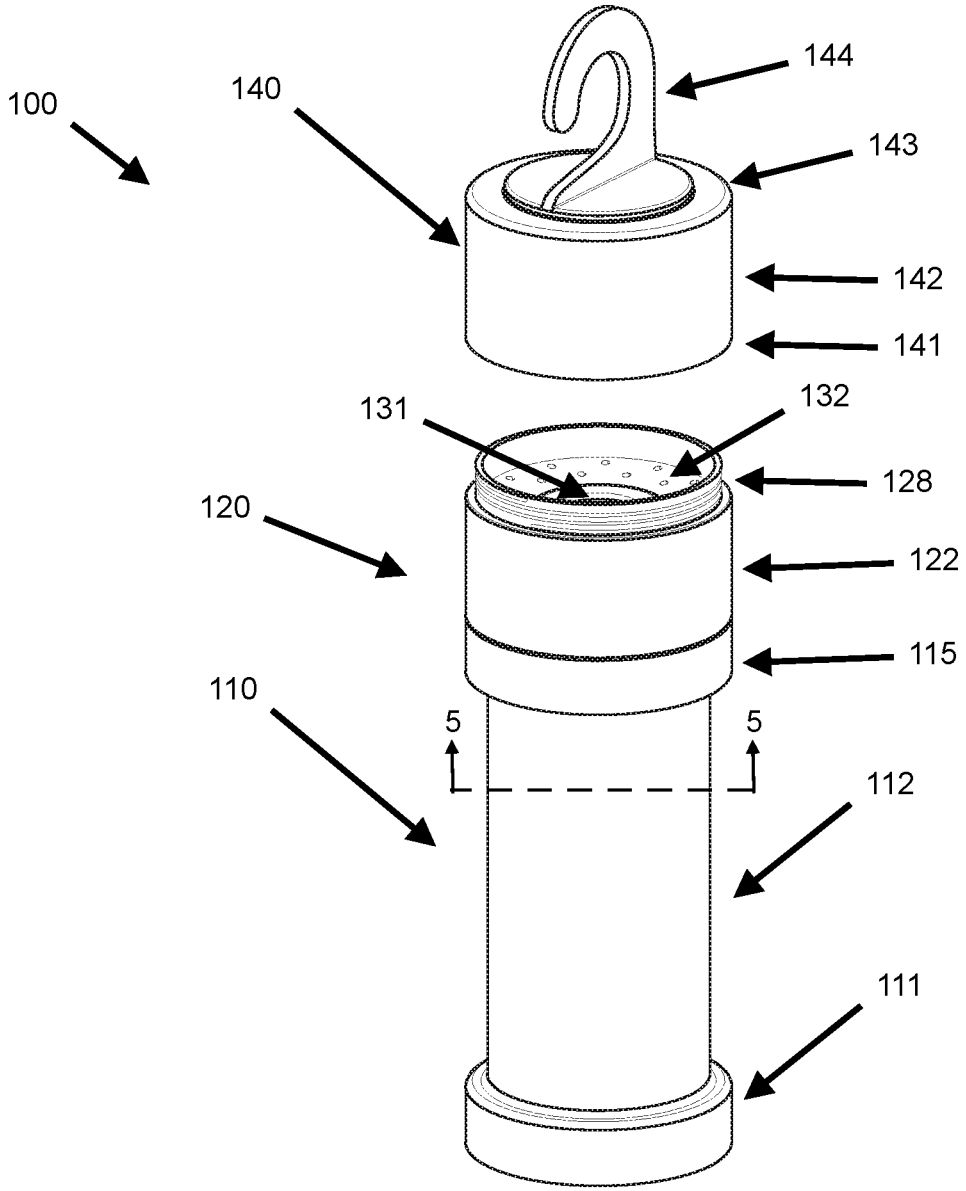
FIG. 1 illustrates an embodiment of the dispenser with the top cover removed a in accordance with the present invention.

In the Summary above and in this Detailed Description, and the claims below, and in the accompanying drawings, reference is made to particular features of the invention. The term "comprises" and grammatical equivalents thereof are used herein to mean that other components, ingredients, steps, etc. are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range including that number (which may be a range having an upper limit or no upper limit, depending on the variable being defined). For example, "at least 1" means 1 or more than 1. The term "at most" followed by a number is used herein to denote the end of a range, including that number (which may be a range having 1 or 0 as its lower limit, or a range having no lower limit, depending upon the variable being defined).

"Exemplary" is used herein to mean "serving as an example, instance, or illustration." Any aspect described in this document as "exemplary" is not necessarily to be construed as preferred or advantageous over other aspects Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

In the following detailed description, numerous specific details are set forth in order to provide a more thorough understanding of the one or more embodiments described herein. However, it will be apparent to one of ordinary skill in the art that the invention may be practiced without these specific details. In other instances, well-known features have not been described in detail to avoid unnecessarily complicating the description.

The present disclosure is generally drawn to a system and method, according to one or more exemplary embodiments, for a dispenser. The dispenser is designed to have interchangeable components including a reservoir base with an ergonomic handle for holding a fluid, a detachable applicator compartment for holding an applicator, and a removable top cover and hook for hanging or for storage purposes. The interchangeable components allow for customization as well as quick and easy replacement for the different components.

With reference now to FIG. 1, one exemplary embodiment of dispenser 100 is shown. The main components of dispenser 100 include a reservoir base 110, applicator compartment 120, and top cover 140. Reservoir base 110 supports dispenser 100 in an upright position on a supporting surface. Reservoir base 110 may have an inner chamber or empty space that extends into reservoir base 110 between the inner walls of reservoir base 110 to receive fluid from an external source and hold fluid until the fluid is dispensed or applied. Reservoir base 110 may be filled with fluid up to a specific height. Fluid may be but is not limited to soaps, shampoos, water, detergents, creams, cleaning fluids, deodorants, polishing liquids, washing powders, etc. Reservoir base 110 is made of a material adapted to be deformed, squeezed, or to withstand applied pressure sufficiently well enough to enable such pressure to force fluid out through reservoir base 110.

Reservoir base 110 may have a bottom element 111, whereby when placed on a support, bottom element 111 comes into contact with the supporting surface. Dispenser 100 as a whole, is generally symmetric about a vertical axis passing through the middle of dispenser 100 perpendicular to bottom surface portion 111 and a supporting surface.

A sidewall portion 112 extends upward from an upper margin of bottom surface portion 111. Sidewall portion 112 then extends upward into a top element 115. Bottom element 111 and top element 115 are of a larger area or circumference than sidewall portion 112 such that dispenser 100 may shaped and dimensioned to be grasped by a user's hand. This allows the user to ergonomically hold dispenser 100 from a single position with their hand on sidewall portion 112 while top element 115 and bottom element 111 prevent the user's hand from being displaced vertically past the length of sidewall portion 112. In other embodiments, reservoir base 110 may be cylindrically shaped with a hollow cylindrical body or any other shape as desired such as a cube or other shaped prism.

Figure 2:
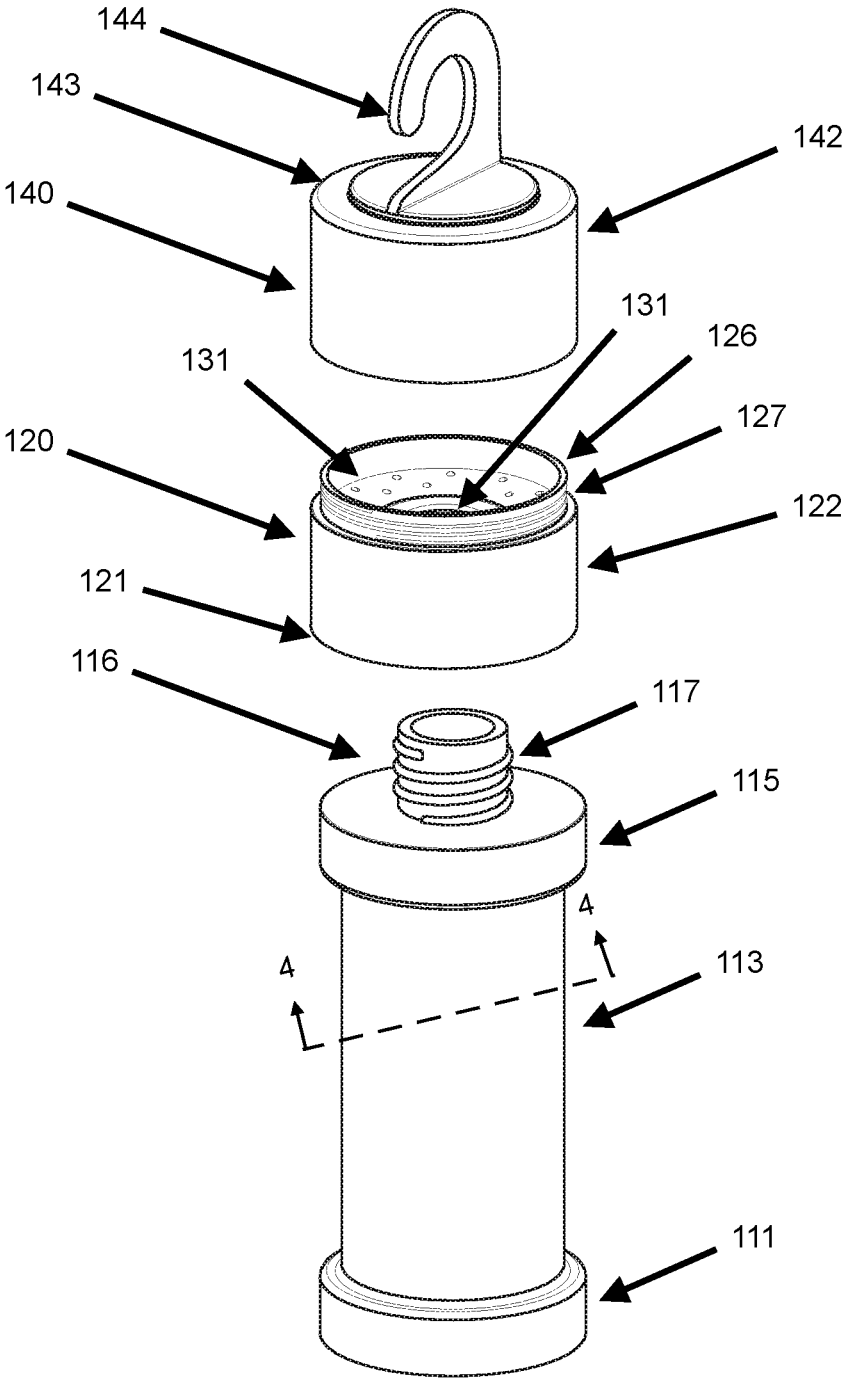
FIG. 2 illustrates an embodiment of the dispenser with the top cover removed in accordance with the present invention.

A neck portion 116, as illustrated in FIG. 2 extends upward from the upper margin of top element 115. Neck portion 116 is of a smaller area or circumference than top element 115. Neck portion 116 is adapted to seal with adapter component 120 which is conventionally secured to neck portion 116 by threads 117.

Applicator compartment 120 may have a cylindrical body with a bottom surface portion 121. A sidewall portion 122 extends upward from an upper margin of bottom surface portion 121. A neck portion 126 extends upward from the upper margin of sidewall portion 122. Neck portion 116 is of a smaller area or circumference than sidewall portion 122. Neck portion 126 is adapted to seal with top cover 140 which is conventionally secured to neck portion 126 by threads 127.

Applicator compartment 120 may have an inner chamber 124 and outer chamber 125 positioned below an upper chamber 129. Inner chamber 124 and outer chamber 125 may be located concentrically to one another whereby outer chamber 125 surrounds inner chamber 124 with respect to the vertical axis. Inner chamber 124 may be hollow with a threaded portion 128. Threaded portion 128 allows applicator compartment 120 to engage with threads 117 of reservoir base 110 to stack upon the other and mechanically lock with each other.

Upper chamber 129 is configured to serve as a container for an applicator 130 to be placed into (e.g. whereby applicator 130 either fits wholly within upper chamber 129 or partially fits within upper chamber 129). Applicator 130 may be semispherical or generally semispherical in shape protruding from upper chamber 129, past neck portion 126 and into top cover 140 when top cover 140 has been mechanically locked with reservoir base 110.

Figure 3:
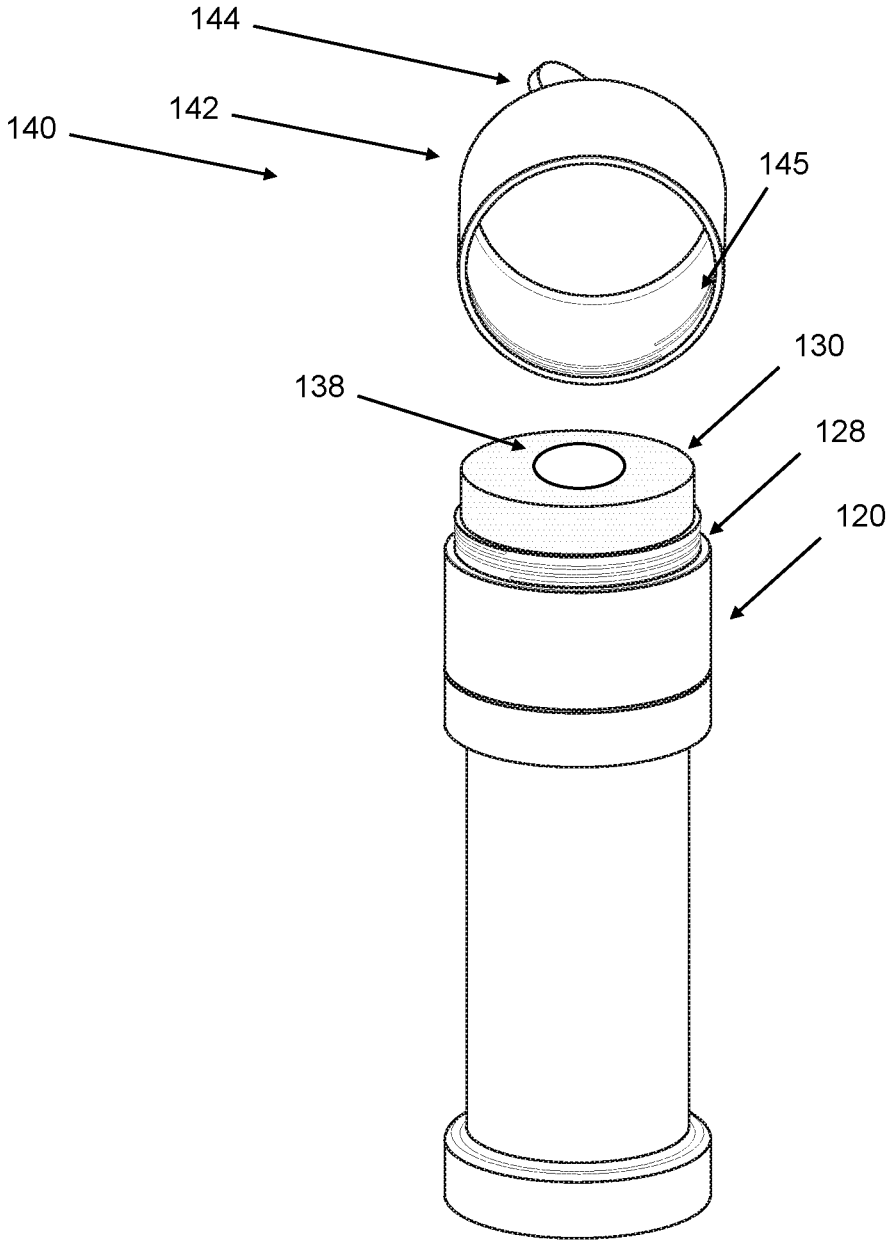
FIG. 3 illustrates the dispenser with the inside of the top cover and the applicator.
Figure 4:
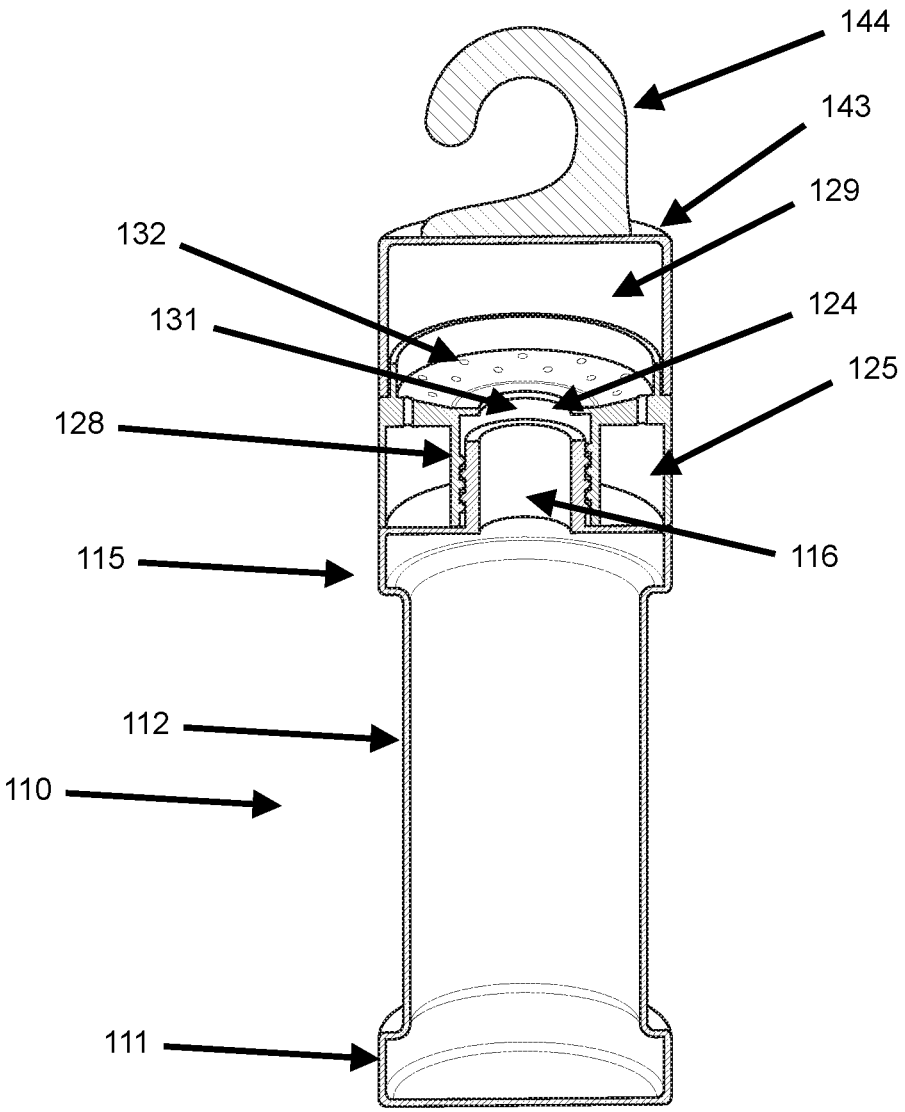
FIG. 4 illustrates a cross sectional view of FIG. 2.
Figure 5:
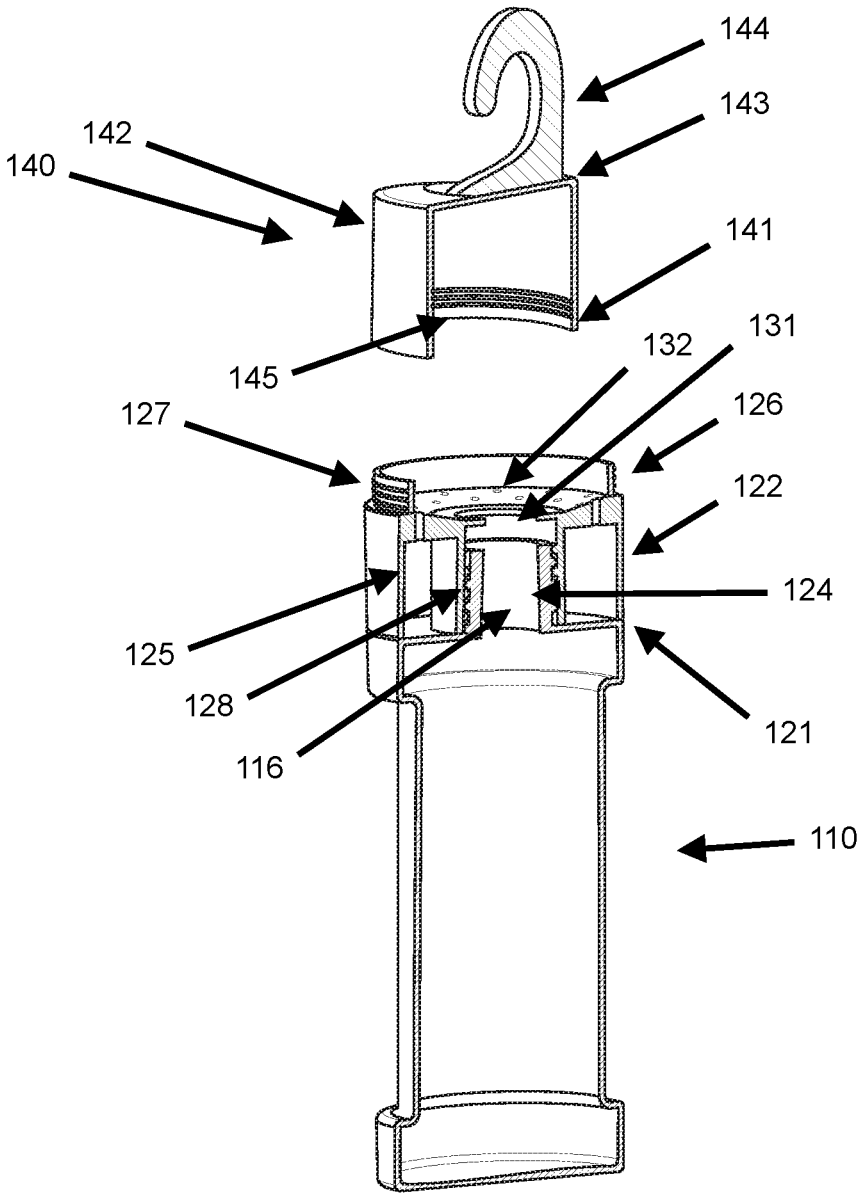
FIG. 5 illustrates a cross sectional view of FIG. 1.

Applicator 130, as illustrated in FIG. 3, may be but is not limited to a sponge or loofah as well as other fluid applicator materials such as brushes, pads, fabric, pumice, rubber, or any composition used in connection with applying fluid. Applicator 130 may itself be modified to include adaptations that improve dispersion of fluid over the surface to which fluid is applied. In one or more embodiments, applicator 130 may have an aperture 138 passing through an area of applicator 130 such that fluid may be move upward through the aperture to the top surface and rupture, causing fluid to flow into or onto the area of applicator 130 surrounding the aperture.

Applicator 130 may be connected to upper chamber 129 with adhesive around the perimeter of applicator 130 and the inner surface of upper chamber 129. However this is non-limiting and applicator 130 and applicator compartment 120 may be connected or fastened to upper chamber 129 by any method known by those of ordinary skill in the art such as but not limited to screws, Velcro®, pressure or snap fit, clips, buckles, nuts and bolts, latches, hinges, or any other type of fasteners.

Upper chamber 129 includes a center aperture 131 at the bottom surface of upper chamber 129 whereby when reservoir base 110 is deformed, squeezed, or applied pressure, fluid is forced out through reservoir base 110 into inner chamber 124 of applicator compartment 120, then into upper chamber 129, whereby fluid then flows into or onto the applicator 130. The fluid then may be applied to the skin of the person or other surface upon contact with the applicator 130. Upper chamber 129 has a plurality of pass-through apertures 132 spaced around center aperture 131 to circulate and drain water vertically into outer chamber 125 and then out of dispenser 100 to prevent the buildup of mold and other particulates inside of dispenser 100.

Top cover 140 may have a cylindrical body with an open bottom surface portion 141. A sidewall portion 142 extends upward from an upper margin of bottom surface portion 141. Sidewall portion 142 may be hollow with a threaded receiving portion 145. Threaded receiving portion 145 allows top cover 140 to engage with threads 127 of applicator compartment 120 to stack upon the other and mechanically lock with each other.

A closed top portion 143 extends upward from the upper margin of sidewall portion 142. A hook 144 extends upward from the upper margin from top portion 143 permitting dispenser 100 to be secured to an apparatus such as a shower whereby hook 144 is placed directly over a shower head, allowing dispenser 100 to be stored between uses in the shower and/or bathtub or other location. In one or more non-limiting embodiments, hook 144 may be replaced by another fastening apparatus such as a carbine or snap hook depending on the situation needed for dispenser 100.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated.

What is claimed is:

1. A dispenser system comprising: a base reservoir configured to hold a fluid; and an applicator compartment housing an applicator, the applicator compartment removably connected to the base reservoir, wherein when the applicator compartment is connected to the base reservoir, the fluid is movable from the base reservoir in or onto the applicator;

a top cover, the top cover removably connected to the applicator compartment, the top cover configured to cover the applicator when connected to the applicator compartment, the applicator compartment having a hollow inner chamber with first connecting elements that are connectable with second connecting elements on a neck portion of the base reservoir and an outer chamber surrounding the inner chamber along a vertical axis, the applicator compartment having an upper chamber, the upper chamber having a bottom surface with a hole in a center wherein the fluid is movable from the base reservoir into the inner chamber and then into the upper chamber through the hole.

2. The dispenser system of claim 1, the base reservoir made of a compressible material.

3. The dispenser system of claim 1, the base reservoir ergonomically contoured to receive a hand of a user, the base reservoir having a top portion and a bottom portion of a greater circumference than a middle portion along a vertical axis.

4. The dispenser system of claim 1, the top cover comprising a hook positionable over an apparatus.

5. The dispenser system of claim 1, the base reservoir having a neck portion extending upward from the top portion of the base reservoir, the neck portion of a smaller circumference than the top portion of the base reservoir, the neck portion having a series of threads.

6. The dispenser system of claim 5, the applicator compartment having a neck portion extending upward, the neck portion having a series of threads that are connectable with thread receiving components on the top cover.

7. The dispenser system of claim 1, the upper chamber having a series of apertures wherein secondary fluids flowing on or into the applicator flow down through the series of apertures into the outer chamber and out of the dispenser system.

8. A dispenser system comprising: a base reservoir configured to hold a fluid;

an applicator compartment housing an applicator, the applicator compartment removably connected to the base reservoir, wherein when the applicator compartment is connected to the base reservoir, the fluid is movable from the base reservoir in or onto the applicator, the applicator compartment having a hollow inner chamber, the applicator compartment having an upper chamber, the upper chamber having a bottom surface with a hole wherein the fluid is movable from the base reservoir into the inner chamber and then into the upper chamber through the hole.

9. The dispenser system of claim 8, the upper chamber having a series of apertures wherein secondary fluids flowing on or into the applicator flow down through the series of apertures into an outer chamber and out of the dispenser system.

10. The dispenser system of claim 8, the base reservoir having a neck portion extending upward from the top portion of the base reservoir, the neck portion of a smaller circumference than the top portion of the base reservoir.

11. The dispenser system of claim 10, the neck portion having a series of threads.

12. The dispenser system of claim 11, the base reservoir made of a compressible material.

13. The dispenser system of claim 12, the base reservoir ergonomically contoured to receive a hand of a user, the base reservoir having a top portion and bottom portion of a greater circumference than a middle portion along a vertical axis.

14. The dispenser system of claim 8, the applicator having an applicator hole through the applicator to produce a rupture effect around at top of the applicator hole.

15. The dispenser system of claim 14, further comprising a top cover, the top cover removably connected to the applicator compartment, the top cover configured to cover the applicator when connected to the applicator compartment.

16. A dispenser system comprising: a base reservoir configured to hold a fluid;

an applicator compartment housing an applicator, the applicator compartment removably connected to the base reservoir, wherein when the applicator compartment is connected to the base reservoir, the fluid is movable from the base reservoir in or onto the applicator, the applicator compartment having a first chamber, the first chamber having a bottom surface with a hole the first chamber configured to receive an applicator wherein the fluid is movable from the base reservoir into the first chamber through the hole and then onto the applicator.

17. The dispenser system of claim 16, the first chamber having a series of apertures wherein a secondary fluid flowing on or into the applicator flow down through the series of apertures into a second chamber and out of the dispenser system.

* * * * *